US007018286B2

(12) United States Patent
Blake et al.

(10) Patent No.: US 7,018,286 B2
(45) Date of Patent: Mar. 28, 2006

(54) COIN HOLDING DEVICE FOR FILLING COIN CASSETTES

(75) Inventors: John R. Blake, St. Charles, IL (US); Timothy L. Esterbrook, Arlington Heights, IL (US); Douglas U. Mennie, Barrington, IL (US); Frank J. Janezic, Lake Barrington, IL (US); Don T. Lambert, Littleton, CO (US); John S. Lykowski, Glenview, IL (US)

(73) Assignee: Cummins-Allison Corp., Mount Prospect, IL (US)

( * ) Notice: Subject to any disclaimer, the term of this patent is extended or adjusted under 35 U.S.C. 154(b) by 296 days.

(21) Appl. No.: 10/159,687

(22) Filed: May 31, 2002

(65) Prior Publication Data

US 2003/0013403 A1 Jan. 16, 2003

Related U.S. Application Data

(60) Provisional application No. 60/295,173, filed on Jun. 1, 2001.

(51) Int. Cl.
*G07D 9/06* (2006.01)

(52) U.S. Cl. ..... 453/61; 206/82; 206/807

(58) Field of Classification Search ..... 453/60, 453/3, 16, 17, 61, 62, 58; 221/175, 178, 221/179, 180, 181, 197, 198, 287; 211/41.1, 211/49.1, 85.18; 206/0.8, 0.81, 0.82, 0.83, 206/0.84, 445, 807; 49/13
See application file for complete search history.

(56) References Cited

U.S. PATENT DOCUMENTS

| | | | | | |
|---|---|---|---|---|---|
| 663,290 | A | * | 12/1900 | Miller | 453/54 |
| 757,612 | A | * | 4/1904 | Gilfillan | 53/202 |
| 781,810 | A | * | 2/1905 | Corbett | 206/0.83 |
| 1,347,179 | A | * | 7/1920 | Schnitzspahn | 453/37 |
| 2,289,002 | A | | 7/1942 | Fleming et al. | 133/8 |

(Continued)

FOREIGN PATENT DOCUMENTS

DE 26 14 560 10/1977

(Continued)

OTHER PUBLICATIONS

Complaint, Cummins-Allison Corp. v. Glory Ltd., Glory Shoji Co. Ltd., and Glory (U.S.A) Inc., Civil Action No. 02C-7008, United States District Court, Northern District of Illinois, Eastern Division.

(Continued)

*Primary Examiner*—Donald P. Walsh
*Assistant Examiner*—Mark J. Beauchaine
(74) *Attorney, Agent, or Firm*—Jenkens & Gilchrist

(57) ABSTRACT

A coin stacking device is used to refill a coin cassette of a coin dispenser. The coin stacking device includes a cylindrical structure having an inner diameter approximately the same as a diameter of the coins. The cylindrical structure has one open end and one closed end. The coins enter the open end and form a coin stack within the cylindrical structure. To refill a coin cassette, the open end of the filled coin stacking device is aligned with a coin receptacle in the coin cassette that is in need of coins. The coin stack is then transferred from the coin stacking device to the coin receptacle of the coin cassette. The coin stacking device can easily filled by an automated coin processing machine, such as a coin sorting machine or a coin counting machine.

19 Claims, 9 Drawing Sheets

U.S. PATENT DOCUMENTS

| | | | | | |
|---|---|---|---|---|---|
| 2,348,936 | A | | 5/1944 | Sprenger | 133/3 |
| 3,016,191 | A | | 1/1962 | Buchholz et al. | 235/92 |
| 3,026,982 | A | | 3/1962 | Buchholz et al | 194/9 |
| 3,748,821 | A | | 7/1973 | Hull et al. | 53/159 |
| 3,757,805 | A | * | 9/1973 | Puhahn et al. | 453/57 |
| 4,040,434 | A | * | 8/1977 | Watanabe et al. | 453/17 |
| 4,226,253 | A | | 10/1980 | Kokubo et al. | 133/4 A |
| 4,230,135 | A | | 10/1980 | Ueda | 133/3 D |
| 4,244,157 | A | * | 1/1981 | Vondra et al. | 53/254 |
| 4,250,904 | A | | 2/1981 | Lueschen | 133/2 |
| 4,263,770 | A | | 4/1981 | Furuya | 53/501 |
| 4,275,751 | A | | 6/1981 | Bergman | 133/3 C |
| 4,307,556 | A | | 12/1981 | Furuya | 53/54 |
| 4,359,062 | A | | 11/1982 | Uecker et al. | 133/2 |
| 4,392,504 | A | | 7/1983 | Sentoku | 133/1 A |
| 4,436,102 | A | | 3/1984 | Kokubo et al. | 133/2 |
| 4,558,712 | A | | 12/1985 | Sentoku et al. | 133/3 R |
| 4,606,360 | A | | 8/1986 | Mills | 133/1 A |
| 4,832,655 | A | | 5/1989 | Sakurai | 453/61 |
| 4,926,996 | A | | 5/1990 | Eglise et al. | 194/212 |
| 4,950,203 | A | | 8/1990 | Tomaiko | 453/59 |
| 5,021,026 | A | | 6/1991 | Goi | 453/40 |
| 5,052,538 | A | | 10/1991 | Satoh | 194/317 |
| 5,059,153 | A | | 10/1991 | Goi | 453/11 |
| 5,178,298 | A | * | 1/1993 | Allina | 221/24 |
| 5,183,142 | A | | 2/1993 | Latchinian et al. | 194/206 |
| 5,209,294 | A | | 5/1993 | Weber | 53/493 |
| 5,366,112 | A | * | 11/1994 | Hinterreiter | 221/198 |
| D359,152 | S | | 6/1995 | Adams et al. | D99/34 |
| 5,429,551 | A | | 7/1995 | Uecker et al. | 453/18 |
| 5,441,448 | A | | 8/1995 | Yang | 453/60 |
| 5,443,419 | A | | 8/1995 | Adams et al. | 453/17 |
| 5,474,496 | A | * | 12/1995 | Perkitny | 453/9 |
| 5,520,577 | A | | 5/1996 | Rasmussen | 453/56 |
| 5,595,338 | A | | 1/1997 | Abler | 229/87.2 |
| 5,827,117 | A | | 10/1998 | Naas | 453/9 |
| 5,865,673 | A | * | 2/1999 | Geib et al. | 453/10 |
| 5,997,395 | A | | 12/1999 | Geib et al. | 453/10 |
| 6,264,545 | B1 | | 7/2001 | Magee et al. | 453/3 |
| 6,318,537 | B1 | | 11/2001 | Jones et al. | 194/346 |
| 2001/0034203 | A1 | | 10/2001 | Geib et al. | 453/3 |

FOREIGN PATENT DOCUMENTS

| | | | | |
|---|---|---|---|---|
| DE | 39 24 199 | A1 | | 1/1990 |
| DE | 197.23.526 | A1 | * | 12/1998 |
| EP | 0 157 405 | | | 10/1985 |
| EP | 0 563 395 | B1 | | 3/1996 |
| EP | 0 744 719 | A2 | | 11/1996 |
| EP | 0 831 431 | A2 | | 3/1998 |
| JP | 9-28913 | | | 2/1997 |
| JP | 10-188075 | | | 7/1998 |
| WO | WO 90/09646 | A1 | * | 8/1990 |
| WO | WO 97/43739 | | | 11/1997 |
| WO | WO 99/30287 | | | 6/1999 |
| WO | WO 99/33030 | | | 7/1999 |

OTHER PUBLICATIONS

Billcon Corporation, Brochure for CCS-60/CCS-80 Series Coin Counter-Sorter, 2 pages (Oct. 1999).

Billcon Corporation, Photos for CCS-60/80, 1 page (Japanese language) (Oct. 12, 2000).

De La Rue Cash Systems, Inc., Brochure for ACD Automatic Coin Dispenser, 2 pages (no date).

De La Rue Cash Systems, Brochure for MACH 12 Coin Sorter/Counter, 2 pages (1999).

De La Rue Cash Systems, Brochure for MACH 12HD Coin Sorter/Counter, 2 pages (no date).

Glory, Brochure for GSA-500 Sortmaster, 2 pages (no date).

Magner, Brochure for COINSTREAM™ CPS 502 Self-Service Coin Processing System, 2 pages (no date).

Magner, Brochure for MAG II 100 Series Coin Sorter, 2 pages (no date).

Magner, Brochure for MAG II Model 915 Coin Counter/Packager, 2 pages (no date).

Magner, Brochure for Pelican 305 Coin Sorter, 2 pages (no date).

Magner, Brochure for 900 Series Coin Counters and Packagers, 2 pages (no date).

* cited by examiner

COIN HOLDING DEVICE FOR FILLING COIN CASSETTES

RELATED APPLICATION

This application claims the benefit of priority of U.S. Provisional Patent Application No. 60/295,173, filed Jun. 1, 2001.

FIELD OF THE INVENTION

The present invention relates generally to coin handling devices and, more particularly, to a novel coin stacking cylinder that is used to reload a coin cassette of a typical coin dispenser.

BACKGROUND OF THE INVENTION

Coin dispensers have been used for a number of years. Coin dispensers have relieved cashiers of the burden of manually handling and counting coins. Banks, casinos, and retail stores are some of the beneficiaries of these machines. As would be expected, these businesses wish to process their coins as quickly and accurately as possible.

Coin dispensers typically contain stacks of coins of several denominations. In the United States, coin dispensers usually contain stacks of quarters, dimes, nickels, and pennies. In a common retail environment, once a customer has provided currency to the cashier to pay for merchandise, the cashier enters the amount paid by the customer at the cash register. The cash register then calculates the amount of "change" that must be returned to the customer, and sends a signal to the coin dispenser instructing it to release a certain combination of coin denominations to be returned to the customer. The coin dispenser releases the coins, which travel along a coin chute that leads to a coin bin where the customer can manually remove the coins. Consequently, the efficiency of the transaction is increased since the cashier is not required to count or handle the coins to be returned to the customer.

In addition to this general retail application, coin dispensers are also useful in several types of automated retail machines. In such systems, the customer provides the automated retail machine with currency, selects an item to be purchased, receives the item from the machine, and may also receive change from the machine that corresponds to the difference between the inputted currency and the cost of the selected item. Again, in this situation, a signal is sent to a coin dispenser instructing it to release a certain coin combination to the customer. Other common uses for dispensers include "change" machines that exchange paper currency or electronic media for coins.

Coin dispensers include one or more coin cassettes that contain the coin stacks. Each coin cassette may include receptacles for each of the denominations to be used by the coin dispenser, or one coin cassette may be dedicated to a specific denomination. The coin cassettes are often a block of material having generally cylindrical receptacles in which the coin stacks reside. The coin receptacles typically intersect a side surface of the coin cassettes such that a portion of the coin stack may reside outside the periphery of the block of material, thereby making it easy to visualize how many coins remain in the receptacle.

One of the problems that has existed for some time in coin dispensers relates to filling the coin cassettes. Often, the coin cassettes are manually filled by repetitiously placing small stacks of coins into the coin receptacles to fill each receptacle. This can be quite a time-consuming process.

Thus, a need exists for a device that can quickly fill a coin cassette. It would be further advantageous if such a device had the ability to be quickly filled by a standard coin sorting machine or coin counting machine.

SUMMARY OF THE INVENTION

A coin stacking device according to the present invention is for stacking coins of a certain denomination that will be used to refill a coin cassette. The coin stacking device includes a cylindrical structure having an inner diameter approximately the same as the diameter of the coins. The cylindrical structure has one open end and one closed end. The coins enter the open end and form a coin stack within the cylindrical structure, preferably by an automated coin processing machine such as a coin sorter or coin counter. To refill a coin cassette, the open end of the filled coin stacking device is aligned with a coin receptacle in the coin cassette that is in need of coins. The coin stack is then transferred from the cylindrical structure to the coin receptacle of the coin cassette.

The coin stacking device may have a viewing slot to determine the height of the coin stack contained therein and visual indicia for measuring a value of the coin stack. A tamper-evident security mechanism may be located at the open end to hinder tampering of the coin stack within the coin stacking device. The coin stacking device may include a coin support platform for lowering the coin stack from the open end of the cylindrical structure into the coin cassette.

The invention further contemplates the use of a coin stacking reservoir in which a plurality of coin stacking devices are fit into a tray such that the user of a coin dispenser can select a certain denomination from the tray and use the selected coin stacking device to refill the coin receptacle of the coin cassette that is in need of coins.

The above summary of the present invention is not intended to represent each embodiment, or every aspect, of the present invention. This is the purpose of the Figures and the detailed description which follow.

BRIEF DESCRIPTION OF THE DRAWINGS

The foregoing and other advantages of the invention will become apparent upon reading the following detailed description and upon reference to the drawings.

Figure 1A:
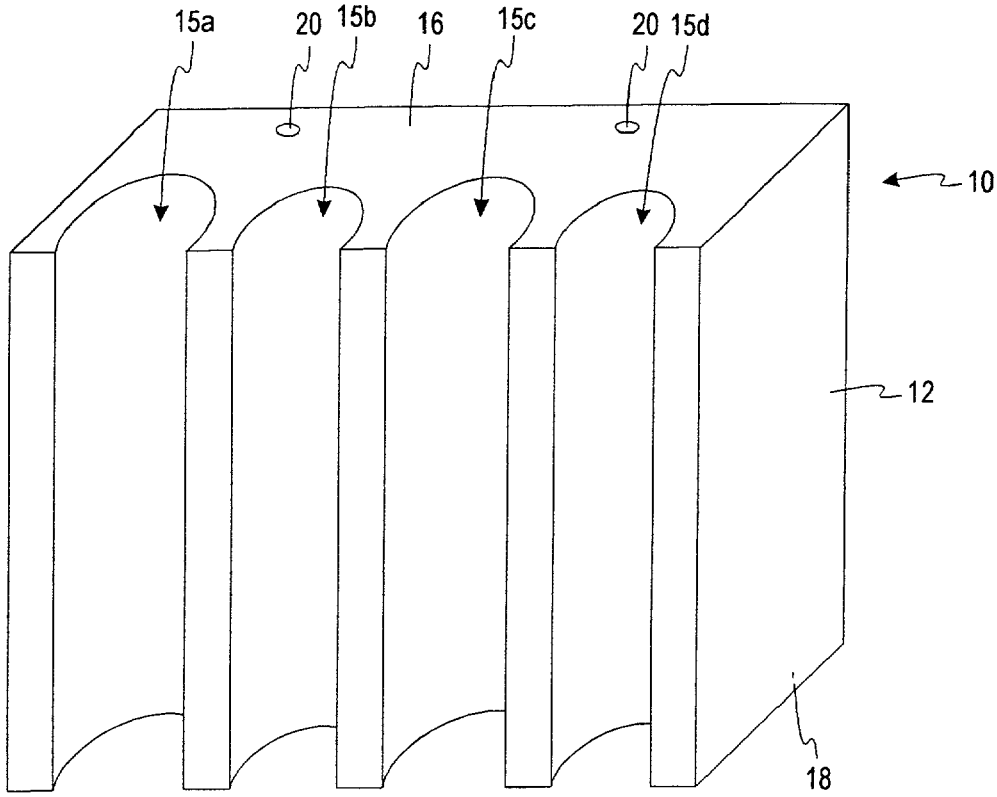
FIGS. 1A and 1B illustrate a typical coin cassette that is used in a coin dispenser.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 1B:
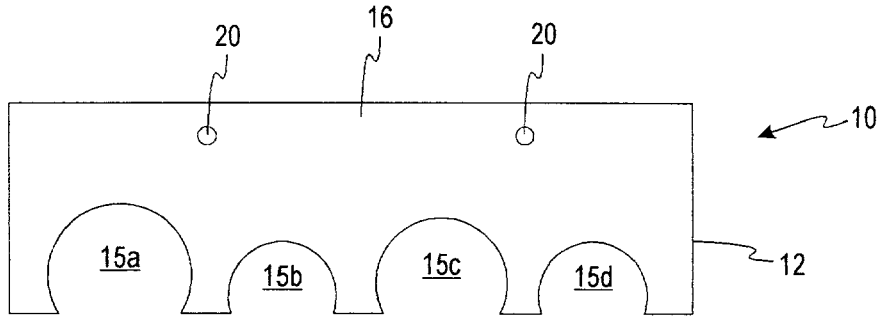

FIGS. 1A and 1B illustrate a typical coin cassette 10 that is used with a coin dispenser. The coin cassette 10 includes a block of material 12 having a plurality of coin receptacles 15*a*, 15*b*, 15*c*, 15*d*. If the coin cassette 10 were used for a U.S. coin set, the coin receptacles 15*a*–15*d* would be used for quarters, dimes, nickels, and pennies, respectively. The coin cassette 10 includes a top end 16 and a bottom end 18. The coin receptacles 15 are filled from the top end 16 and dispense coins from the bottom end 18. The coin cassette 10 may also include registration guides 20 allowing for the coin cassette 10 to be precisely placed within the coin dispenser machine.

In use, the coin dispensing machine includes a plurality of dispensing fingers near the bottom end 18 of the coin cassette 10 that are located adjacent to a corresponding one of the coin receptacles 15. The dispensing fingers control the release of coins from the coin receptacles 15. Other configurations for coin cassettes are available, and the present invention is useful for these other configurations, as well.

Figure 2:
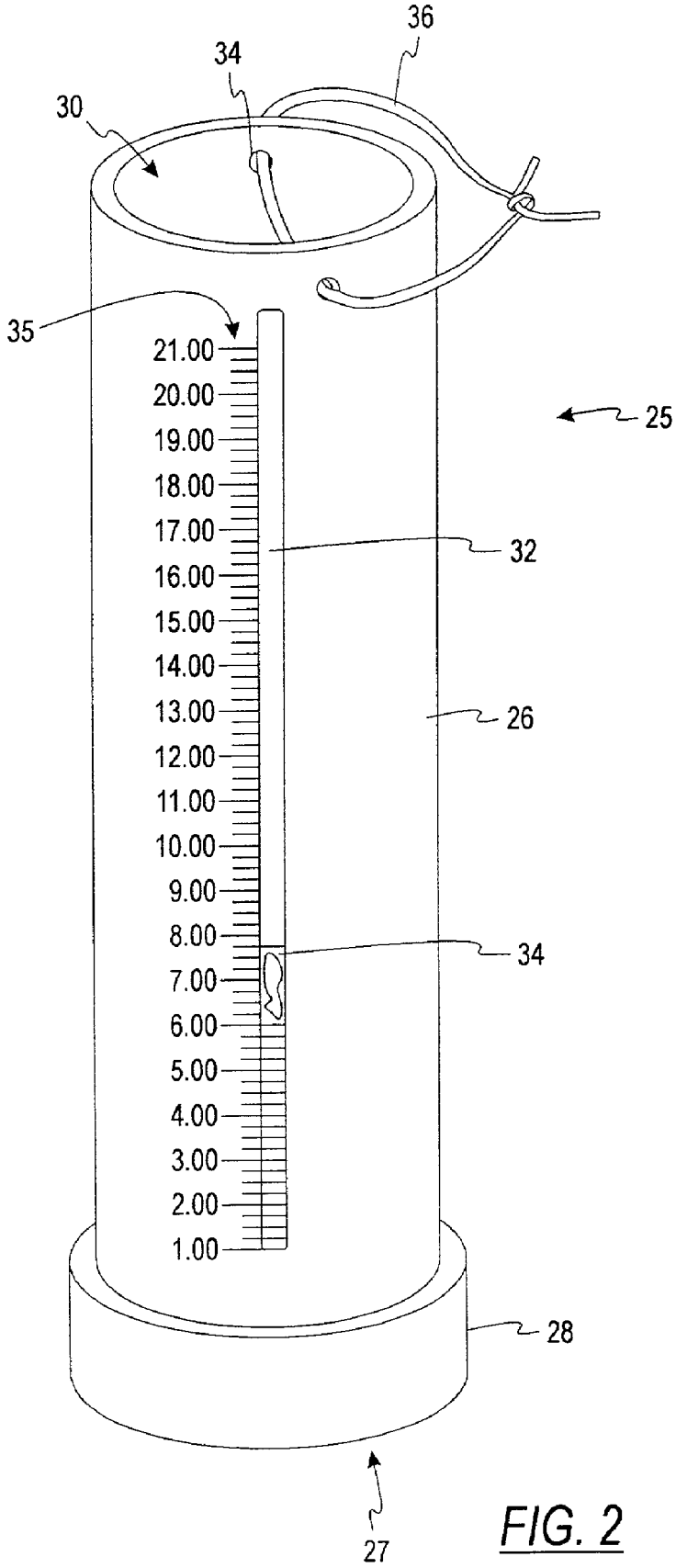
FIG. 2 illustrates one embodiment of a novel coin stacking cylinder according to the present invention.

FIG. 2 illustrates a coin stacking cylinder 25 that is used to fill one of the coin receptacles 15 of the coin cassette 10. The coin stacking cylinder 25 includes a tubular body 26 having a closed end 27 in the form of a cap 28 and an open end 30 opposing the closed end 27. The tubular body 26 is rigid and may be formed of various materials including polymers, such as PVC. The cap 28 can be made of a similar material and may be glued onto the lower end of the tubular body 26. The inner diameter of the tubular body 26 has a diameter that is slightly greater than the diameter of the coins contained therein.

The tubular body 26 includes a viewing slot 32 that allows the user to determine whether a coin stack 34 is present within the coin stacking cylinder 25. Additionally, the tubular body 26 includes visual indicia 35 adjacent to the viewing slot 32 that allows the user to determine the value of the coins of the coin stack 34. As shown, the coin stacking cylinder 25 is for use with quarters and the coin stack 34 contains a value of coins equal to $6.00. While a viewing slot 32 is shown on the coin stacking cylinder 25, the coin stacking cylinder 25 can alternatively be made of a transparent material through which the user can readily determine whether a coin stack 34 is present within the coin stacking cylinder 25. In such an embodiment, visual indicia 35 on the tubular body would again be helpful for determining the actual value of the coin stack 34.

Once the coin stacking cylinder 25 has been filled to the desired level, it may be useful to provide a tamper-evident security closure at the open end 30. Various forms of tamper-evident closures can be provided. In its simplest form, the tubular body 26 may include two security openings 34 through which a security tie 36 can be inserted and tightly tied. Alternatively, three or more security openings 34 for receiving the security tie 36 can be provided to further close the open end 30 and prohibit the removal of any coins within the coin stack 34. Once it is desired to remove the coin stack 34 from the coin stacking cylinder 25, the security tie 36 can be cut and removed from the open end 30.

In yet another type of tamper-evident security closure, a piece of tape can be placed across the open end 30 to close it. A quick-drying adhesive or resin can be applied across the ends of the tape on the opposing sides of the coin stacking cylinder 25 such that any attempt to remove the tape will cause a "break line" in the adhesive or resin.

While FIG. 2 illustrates the coin stacking cylinder 25 that includes the tamper-evident feature at the open end 30, the viewing slot 32, and the visual indicia 35, the coin stacking cylinder 25 does not need these features to perform its primary function. Specifically, the coin stacking cylinder 25 that lacks these features can easily be loaded through the open end 30 so as to produce a coin stack 34 and can be used for filling the coin cassette 10 shown in FIGS. 1A and 1B.

Figure 3:
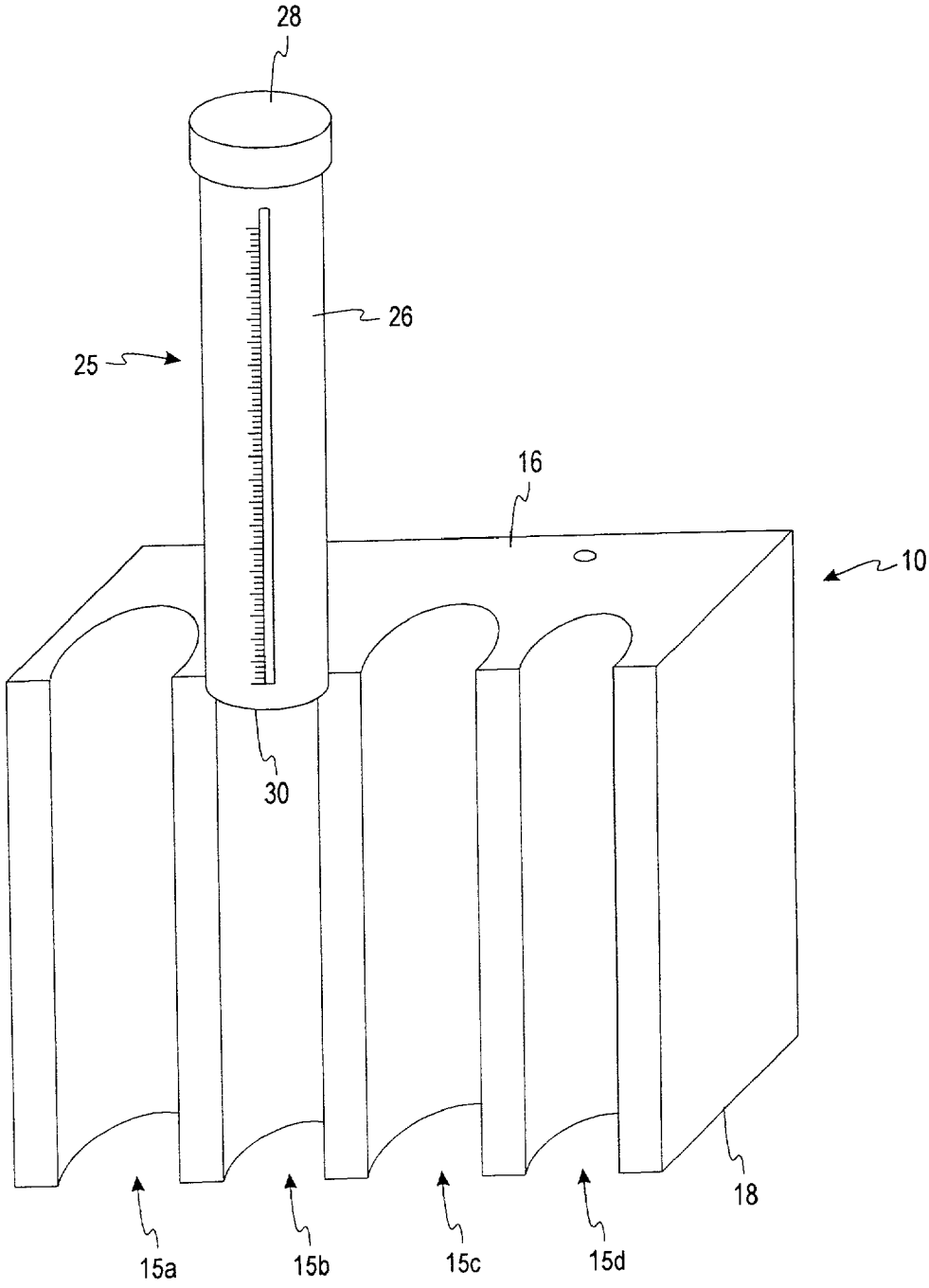
FIG. 3 illustrates the coin stacking cylinder of FIG. 2 in use on the coin cassette of FIG. 1.

FIG. 3 illustrates the coin cassette 10 being filled by a coin stacking cylinder 25. To accomplish this task, any tamper-evident security device that is placed on the open end 30 of the tubular body 26 is first removed (assuming one is present). Next, the open end 30 is temporarily closed by the user's finger or a simple flat structure placed over the open end 30. The coin stacking cylinder 25 is then rotated such that gravity causes the coin stack 34 to be located adjacent the open end 30. The coin stacking cylinder 25 is then aligned over the receptacle in need of coins which, in this case, is coin receptacle 15*b*. The coin stack is then lowered into the coin receptacle 15*b* by lowering the user's finger or the flat structure supporting the coin stack 34. The coin stack is lowered until its coins are located in the coin receptacle 15*b* near the bottom end 18 of the coin cassette 10. If no coins are present in the coin receptacle 15*b*, the coin stack 34 is lowered from the coin stacking cylinder 25 until the lowermost coin engages the structure that is used by the coin dispenser to release the coins from the coin receptacle 15*b*.

Figure 4:
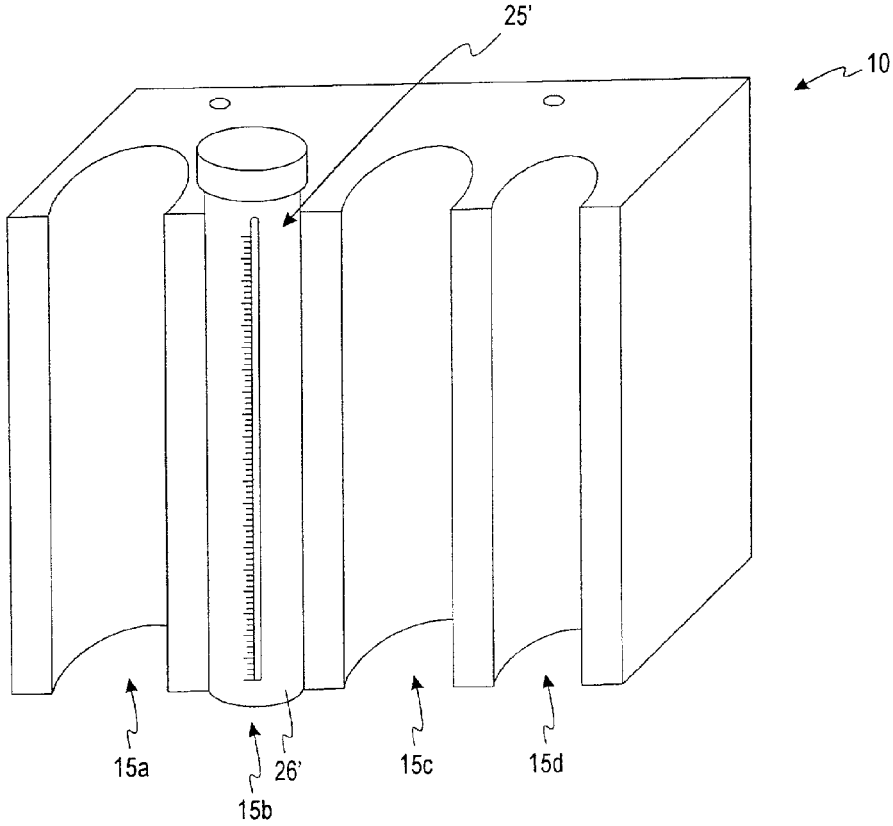
FIG. 4 illustrates an alternative coin stacking cylinder that fits within one of the coin receptacles of the coin cassette of FIG. 1.

FIG. 4 illustrates an alternative coin stacking cylinder 25' that has a tubular body 26' made of a very thin material. Accordingly, the coin stacking cylinder 25' fits within the walls defining the coin receptacle 15*b* of the coin cassette 10. In this situation, the coin stacking cylinder 25' can remain within the coin cassette 10 as the coin dispenser operates. When the coin cassette 10 is in need of a refill of coins for coin receptacle 15*b*, the coin stacking cylinder 25' is removed and a new, filled coin stacking cylinder 25' replaces it.

Figure 5:
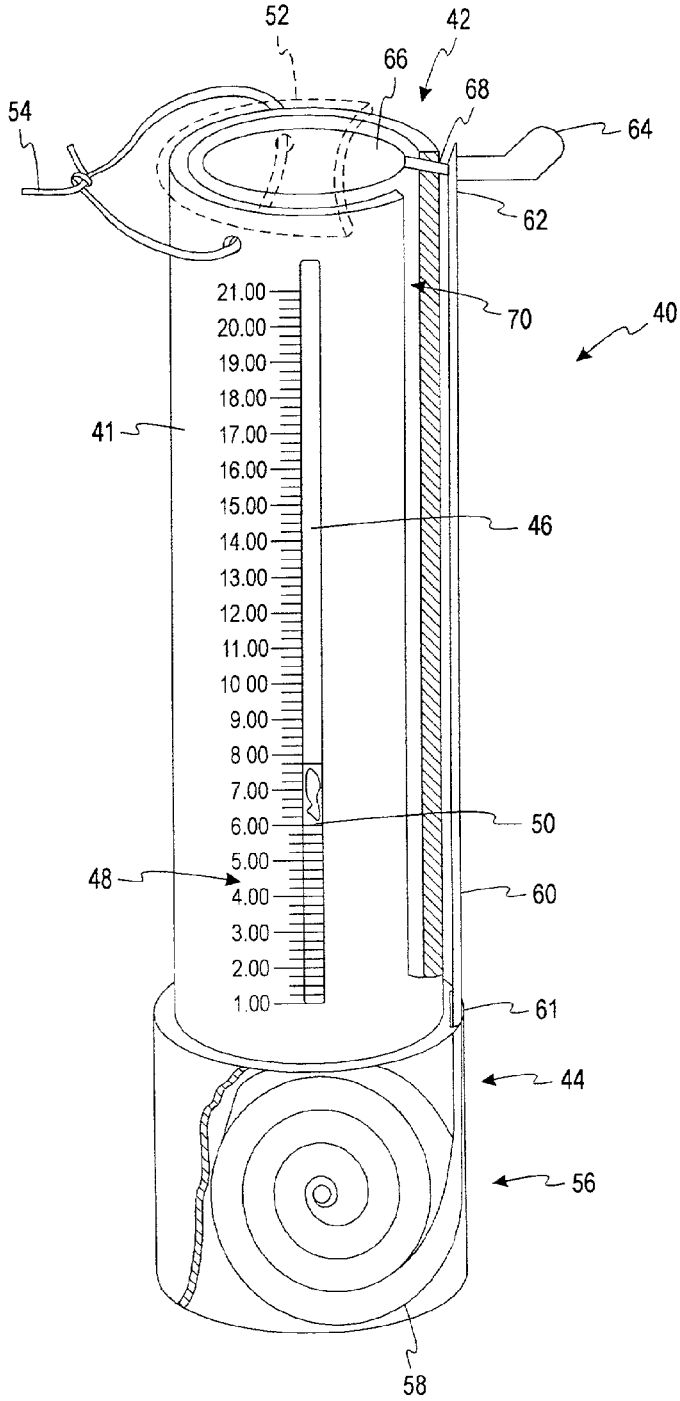
FIG. 5 illustrates an alternative coin stacking cylinder that includes a coin support platform coupled to a retractable coil and a tamper-evident security mechanism at the open end of the coin stacking cylinder.

FIG. 5 illustrates an alternative coin stacking cylinder 40 that includes a tubular body 41 with an open end 42 and a closed end 44. The tubular body 41 of the coin stacking cylinder 40 includes a viewing slot 46 having visual indicia 48 adjacent to the viewing slot 46 for determining the amount of the coin stack 50 placed within the coin stacking cylinder 40. The coin stacking cylinder 40 includes a security cap 52 (shown in dashed lines) that covers at least a portion of the open end 42. The security cap 52 includes openings that are aligned with openings in the tubular body 41 through which a security tie 54 can be inserted to hold the security cap 52 rigidly on the open end 42.

Additionally, the coin stacking cylinder 40 includes an enlarged cap 56 that includes a retractable coil 58. The retractable coil 58 is spring-loaded such that its extending portion 60, which fits through a slot 61 in the cap 56, can move upwardly and downwardly along the tubular body 41. The terminal end 62 of the extending portion 60 is coupled to a manual lever 64 and a coin support platform 66. A bridging element 68 joins the terminal end 62 of the extending portion 60 and the coin support platform 66. The bridging element 68 is configured to fit within an axial slot 70 along the tubular body 41.

In operation, the coin support platform 66 is rotated around the terminal end 62 of the extending portion 60 through manipulation of the manual lever 64 to expose the open end 42. With the open end 42 now exposed, coins can be placed within the tubular body 41 to develop a coin stack 50. When the desired amount of coins in the coin stack 50 is attained, the manual lever 64 can be manipulated to rotate the coin support platform 66 back over the open end 42. Optionally, the manual lever 64 can be further manipulated to lower the coin support platform 66 into engagement with the top coin in the coin stack 50. If the tamper-evident security cap 52 is used, at this point, it is placed over the open end 42 such that it covers the open end 42 of the coin support platform 66. The security tie 54 is inserted through the openings in both the security cap 52 and the openings in the tubular body 41 and its free ends are tightly tied together.

When the coin stack 50 is used to fill the coin cassette 10, the security tie 54 is broken and the security cap 52 is removed from the open end of the tubular body 41. The manual lever 64 is then slid into engagement with the top coin of the coin stack 50, if it is not already in this position. The coin stacking cylinder 40 is then rotated such that gravity causes the coin stack 50 to be supported by the coin support platform 66. The open end 42 of the coin stacking cylinder 40 is then aligned with the desired coin receptacle 15 and the coin cassette 10 for the coin dispenser. The user then grasps the manual lever 64 and lowers the coin stack 50 into the coin receptacle 15 for the coin cassette 10 as the bridging element 68 fits within the opening of the coin receptacle 15 in the coin cassette 10. Because the coin support platform 66 may be wider than the width of the opening of the coin receptacle 15 of the coin cassette 10, it is removed from the coin receptacle 15 once it engages the coin stack support structure within the coin dispensing machine that is located below the bottom end 18 and the coin cassette 10 in FIGS. 1A and 1B. Alternatively, the coin support platform 66 can have a width that is less than the width of the axial opening in the coin receptacle 15 such that it can be moved in the radial direction (with respect to the central axis of the coin receptacle 15) and removed from the coin receptacle via the axial opening.

Figure 6:
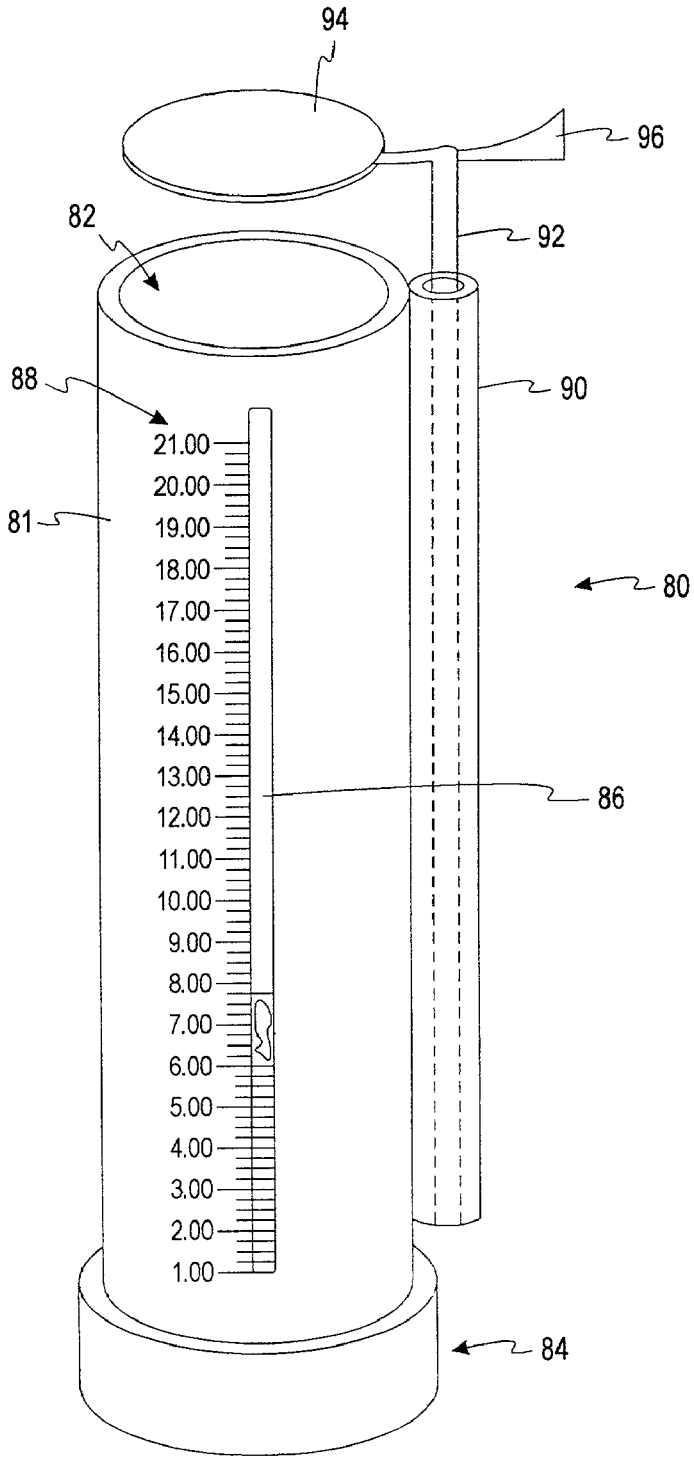
FIG. 6 illustrates an alternative coin stacking cylinder that includes a coin support platform mounted to a guide rod.

FIG. 6 illustrates an alternative coin stacking cylinder 80. The coin stacking cylinder 80 includes a tubular body 81 having an open end 82, a closed end 84, a viewing slot 86, and indicia 88 indicating the value of the stacked coins. The tubular body 81 may be translucent, obviating the need for the viewing slot 86. The coin stacking cylinder 90 includes a guide tube 90 attached to the tubular body 81. A guide rod 92 slides within the guide tube 90. The guide rod 92 has an upper end that includes a coin support platform 94 and a manipulating lever 96.

In operation, the coin stacking cylinder 80 is filled by moving the coin support platform 94 out of alignment with the open end 82 by rotating the manipulating lever 96. Once the coins are filled to develop a coin stack within the coin stacking cylinder 80, the coin support platform 80 is rotated back into position over the open end 82 of the coin stacking cylinder 80. To use the coin stacking cylinder 80 to refill a coin cassette 10, the coin stacking cylinder 80 is rotated such that the coin stack within the coin stacking cylinder 80 rests upon the coin support platform 94. The open end 82 is then aligned with the receptacle 15 in the coin cassette 10 and the user uses the manipulating lever 96 to lower the entire stack into the coin receptacle 15 of the coin cassette 10.

Unlike the coin stacking cylinder 40 of FIG. 5, the coin support platform 94 cannot enter the cylindrical cavity of the tubular body 81. Instead, it can only be moved away from the open end 82 of the coin stacking cylinder 80. By removing some of the material of the guide tube 90 and the tubular body 81, however, the configuration of FIG. 6 can be altered such that the coin support platform 94 can be moved within the tubular body 81.

Once the coin stack is in position within the coin cassette 10, the coin stacking cylinder 80 can be moved away from the coin cassette 10 (ie, in the radial direction with respect to the cylindrical receptacle 15 of the coin cassette 10) if the coin support platform 94 has a width that is less than the width of the axial opening on the side of the coin receptacle 15 of the coin cassette 10. If the coin support platform 94 has a width that is larger than the width of the axial opening, the coin support platform 94 needs to be moved to a position below the lower end 18 of the coin cassette 10 before moving the coin stacking cylinder 80 away from the coin cassette 10.

Figure 7:
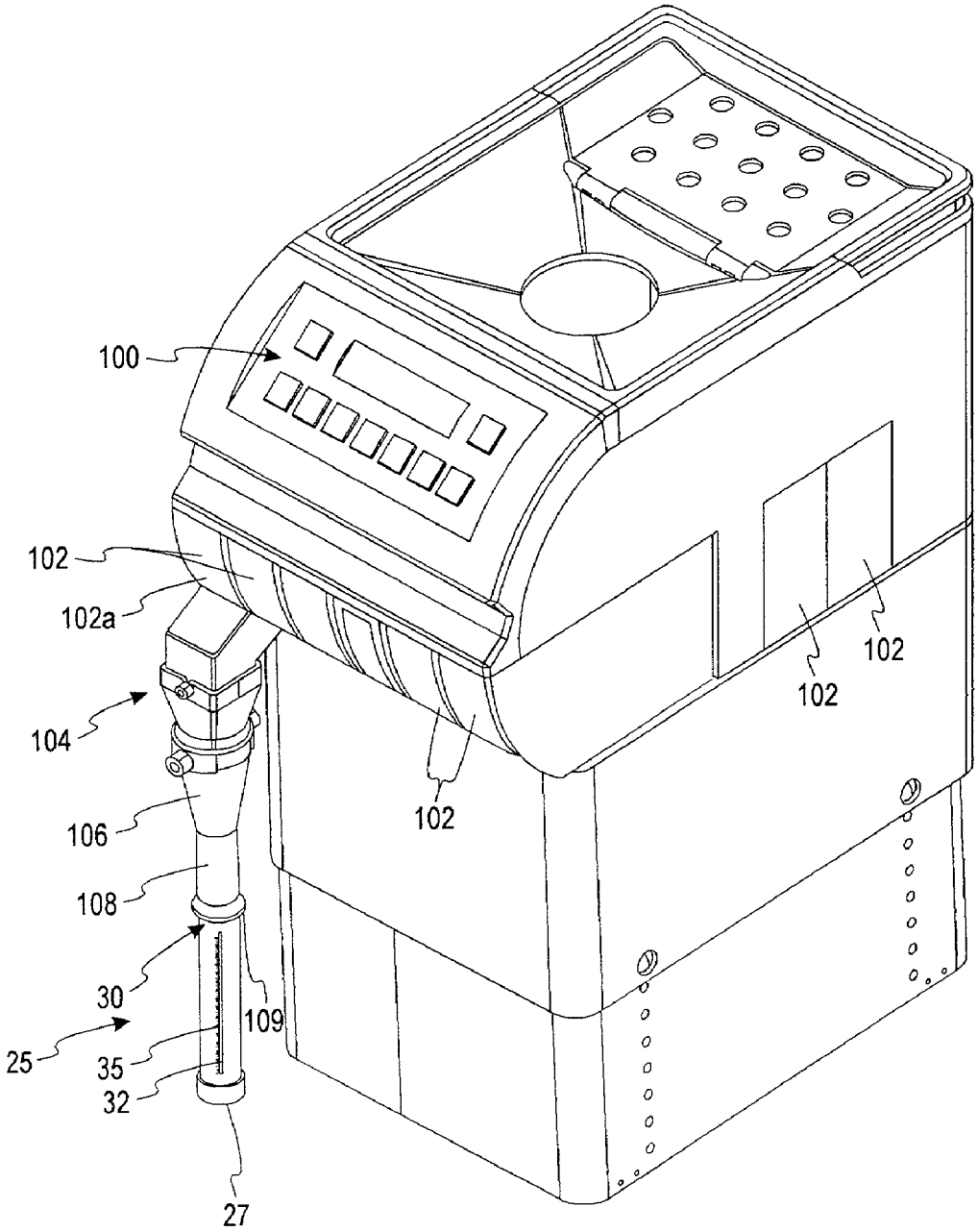
FIG. 7 illustrates the coin stacking cylinder according to the present invention being filled by a typical coin sorting machine.

FIG. 7 illustrates a coin sorter 100 that receives and sorts coins of various denominations into a plurality of coin bins 102. Such a sorter is described in U.S. Pat. No. 5,997,395 which is incorporated herein by reference in its entirety. One of the coin bins 102*a*, has an adapter 104 with a tapering region 106 and a cylindrical region 108. Below the cylindrical region 108, the coin stacking cylinder 25 of FIG. 2 is placed with its open end 30 abutting a fitting 109 at the lowermost end of the cylindrical region 108. While the coin stacking cylinder 25 of FIG. 2 is shown in use in the system of FIG. 7, the other coin stacking cylinders work in FIG. 7 in a similar fashion. The closed end 27 of the coin stacking cylinder 25 is positioned away from the fitting 109. As coins are sorted into the denomination that is desired for filling the coin stacking cylinder 25, they are discharged one at a time through the adapter 104 and into the coin stacking cylinder 25. The coin sorter 100 may be programmed to stop the sorting process when a predetermined number of coins have been sent into the coin stacking cylinder 25. Alternatively, the operator of the coin sorter 100 can manually stop the machine by monitoring the visual indicia 35 adjacent to the viewing slot 32.

The coin stacking cylinder 25 can be held in place under the adapter 104 by manual force. Alternatively, a simple mechanical latching mechanism can be used to hold the coin stacking cylinder 25 on the fitting 109 of the adapter 104. One other possible configuration entails the use of a set of permanent magnets adjacent to the open end 30 that will magnetically hold the coin stacking cylinder 25 on the fitting 109, assuming the fitting 109 is made of a ferrous material.

The present invention contemplates using the coin sorter 100 with multiple adapters 104 being used to fill multiple coin stacking cylinders 25. The multiple coin stacking cylinders 25 may contain different denominations such that multiple denominations can be sorted and subsequently filled into corresponding ones of the coin stacking cylinders 25. If multiple denominations are sent to the plurality of coin stacking cylinders 25, the coin sorter 100 would preferably have a second coin bin for each denomination being sorted such that if a coin stacking cylinder 25 reached its capacity, an internal switch would send coins of that denomination to the coin bin 102 associated with that particular denomination so as to avoid overfilling the coin stacking cylinder 25. Alternatively, the coin sorter 100 could be programmed to stop the coin processing when one of the coin stacking cylinders 25 reaches its capacity and to instruct the user of the coin sorter 100 to remove the filled coin stacking element 25 and replace it with an empty coin stacking element 25.

Figure 8:
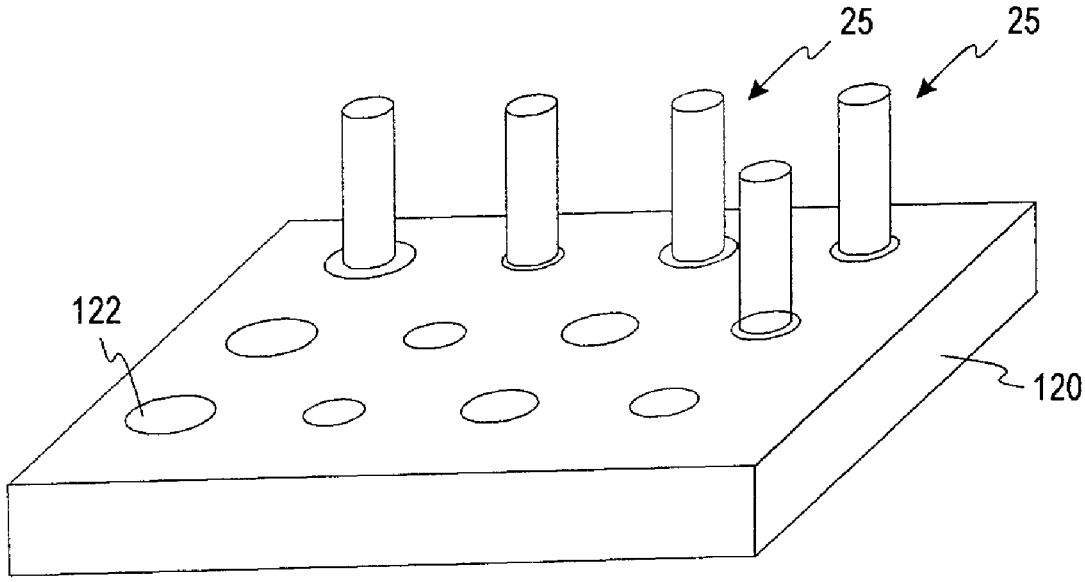
FIG. 8 illustrates a tray for holding several coin stacking cylinders.

FIG. 8 illustrates a tray 120 with a plurality of openings 122 for holding a plurality of filled coin stacking cylinders 25, preferably containing several denominations. The tray 120 is to act as a coin reservoir that is accessible by the user of the coin dispenser. When one of the coin receptacles 15 in coin cassette 10 in the dispenser is empty, the user of the coin dispenser simply grabs the coin stacking cylinder 25 having the needed denomination and uses it to refill the empty receptacle 15 in the coin cassette 10. The user may optionally placed the empty coin stacking cylinder 25 back into the tray 120 to store the empty coin stacking cylinder 25 until it can be filled again, preferably by an automated coin sorter or coin counter.

Figure 9:
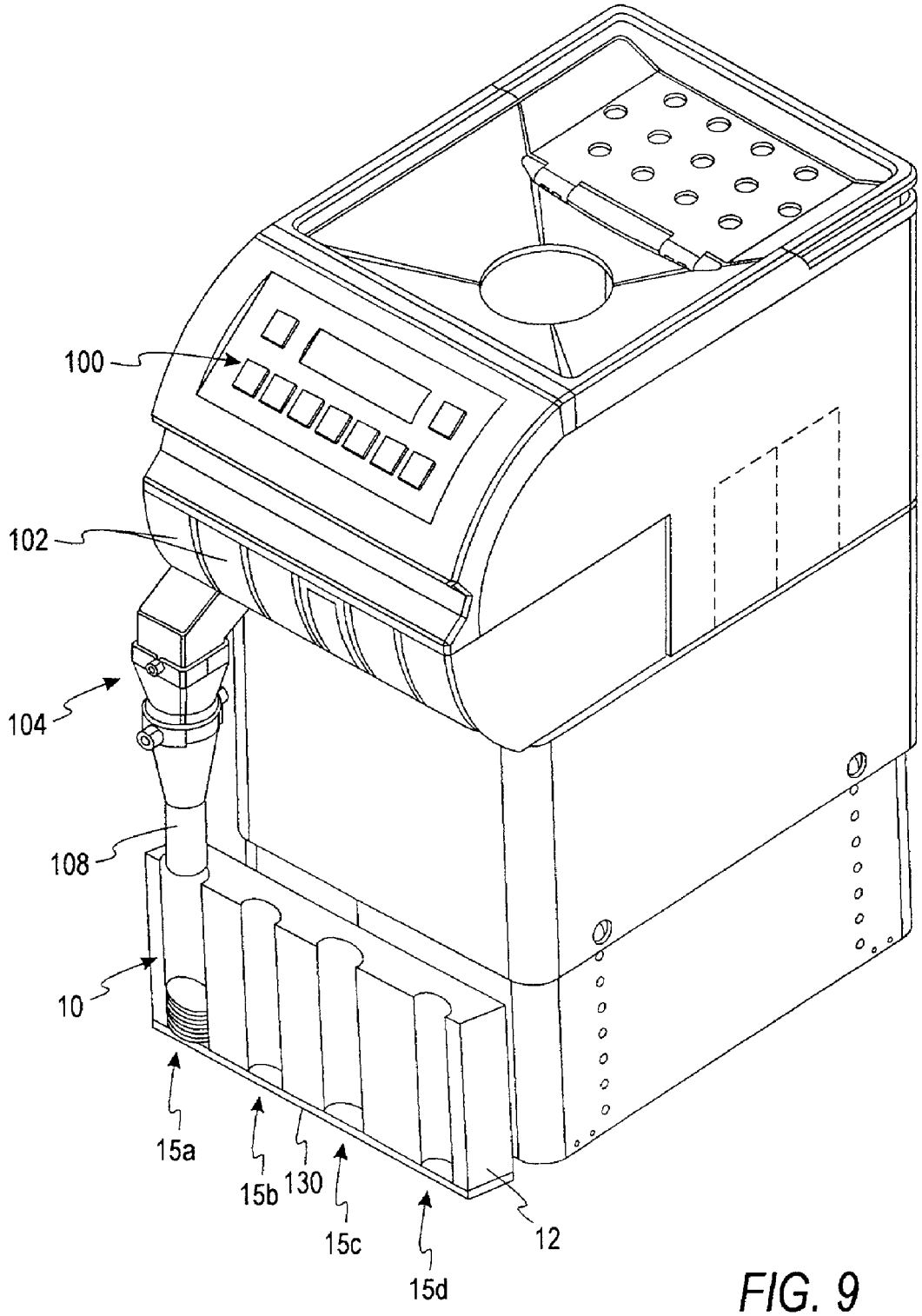
FIG. 9 illustrates a coin sorter directly filling a coin cassette.

FIG. 9 illustrates the coin cassette 10 being directly filled by the coin sorter 100. While only one adapter 104 is shown leading from the coin sorter 100 to the first receptacle 15*a*, this embodiment contemplates using multiple adapters 104 to feed coins into the other three receptacles 15*b*, 15*c*, 15*d* of the coin cassette 100.

In this system, a structure 130 is placed at the bottom end 18 of the coin receptacles 15 to maintain the coins in those receptacles 15. If the coins are bouncing too much as they enter the coin receptacles 15, causing them to not lie flat in a coin stack, the structure 130 can be extended up the side of the coin cassette 10 and have curved surfaces that form the remaining portions of partial cylindrical receptacles 15. Thus, the coins are essentially entering a cylindrical receptacle 15 that is partially defined by the block of material 12 of the coin cassette 10 and partially defined by the curved surfaces of the structure 130.

The conical portions of the adapters 104 may be made of flexible material, allowing the adapter 104 to be slightly offset to the left or the right so that the cylindrical portion is aligned with the corresponding coin receptacle 15. In the embodiment of FIG. 9, the fitting 109 on the adapter 104 illustrated in FIG. 7 has been removed such that the cylindrical section 108 leads directly into the coin receptacles 15 in FIG. 9. A mechanical latch holds the cylindrical portion of the adapter 104 over the coin receptacle 15*a* once proper alignment has been achieved.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A device for holding a stack of coins of a certain denomination, comprising:

a rigid cylindrical structure having an inner diameter approximately the same as a diameter of the coins, said rigid cylindrical structure having one open end and one closed end and including a moveable coin platform adjacent said open end for lowering said coin stack away from said open end, said coins entering said open end and forming a coin stack within said cylindrical structure, wherein said moveable coin support platform is coupled to a guide rod that slides within a guide tube on said rigid cylindrical structure.

2. The device of claim 1, wherein said closed end is formed by a separate cap.

3. The device of claim 1, further including a slot in said rigid cylindrical structure for viewing said coin stack.

4. The device of claim 1, further including indicia for determining the value of said coin stack.

5. The device of claim 1, wherein said moveable coin platform is coupled to a retractable coil.

6. The device of claim 5, wherein said retractable coil is mounted at said closed end.

7. A device for holding a stack of coins of a certain denomination, comprising:

a rigid cylindrical structure having an inner diameter approximately the same as a diameter of the coins, said rigid cylindrical structure having one open end and one closed end and including a moveable coin platform adjacent said open end for lowering said coin stack away from said open end, said coins entering said open end and forming a coin stack within said cylindrical structure, wherein said moveable coin support platform is coupled to a member movable in a substantially lateral direction relative to a central axis of said rigid cylindrical structure.

8. A device for holding a stack of coins of a certain denomination, comprising:

a cylindrical structure having an inner diameter approximately the same as a diameter of the coins, said cylindrical structure having one open end and one closed end, said coins entering said open end and forming a coin stack within said cylindrical structure, said cylindrical structure having visual indicia for measuring a value of said coin stack;

a tamper-evident security mechanism at said open end to hinder tampering of said coin stack within said cylindrical structure; and a coin support platform for lowering said coin stack from said open end of said cylindrical structure after said security mechanism is disengaged.

9. The device of claim 8, wherein said tamper-evident security mechanism includes a security tie.

10. The device of claim 8, wherein said coin support platform is coupled to a retractable coil.

11. The device of claim 10, wherein said retractable coil is mounted at said closed end.

12. The device of claim 8, wherein said coin support platform is coupled to a guide rod that slides within a guide tube on said rigid cylindrical structure.

13. A method of filling a coin cassette, comprising:

loading an open end of a coin tube with coins so as to form a coin stack at a closed end of said tube;

aligning said open end of a tube with a coin receptacle in said coin cassette; and transferring said coin stack from said coin tube to said coin receptacle of said coin cassette.

14. The method of claim 13, wherein said loading includes filling said coin tube with an automated coin processing machine.

15. The method of claim 13, wherein said transferring includes lowering said coin stack from said coin tube.

16. The method of claim 15, wherein said lowering includes manipulating a lever that is coupled to said platform.

17. The method of claim 15, wherein said lowering includes holding the coin stack on a platform and lowering said platform.

18. The method of claim 13, further including securing said open end of said coin tube.

19. The method of claim 13, wherein said aligning includes lowering said coin tube to fit within said coin receptacle.

* * * * *